US005865691A

United States Patent [19]

Chen

[11] Patent Number: 5,865,691

[45] Date of Patent: Feb. 2, 1999

[54] COMBINATION OF SPORTS GAME APPARATUS

[76] Inventor: Charlene Chen, 3 Fl.-3, No. 88, Sec. 3, Shin-Sheng S. Rd., Taipei, Taiwan

[21] Appl. No.: 71,365

[22] Filed: Apr. 30, 1998

[30] Foreign Application Priority Data

May 10, 1997 [TW] Taiwan ..... 86207575

[51] Int. Cl.[6] ..... A63B 63/00

[52] U.S. Cl. ..... 473/416; 473/478; 473/479; 473/490

[58] Field of Search ..... 473/470, 471, 473/472, 473, 474, 476, 478, 479, 490, 493, 481, 416; 273/398, 400, 401, 402

[56] References Cited

U.S. PATENT DOCUMENTS 4,762,319 8/1988 Krumholz ..... 473/416

4,786,053 11/1988 Barnes, Jr. ..... 473/416

5,249,796 10/1993 Silvi ..... 473/416

5,558,338 9/1996 Taub ..... 473/416

*Primary Examiner*—William H. Grieb

*Attorney, Agent, or Firm*—Pro-Techtor International Services

[57] ABSTRACT

A combination of sports game apparatus including a plurality of U-blocks, a plurality of triangle blocks, a plurality of elongated tubes, a plurality of L-bars, a plurality of angle connectors, and a plurality of coupling tubes, and adapted to be alternatively arranged into a framework for a net assembly for badminton or tennis, a framework for a goal for soccer or hockey, or a framework for a back stop for basketball.

1 Claim, 7 Drawing Sheets

21
221
223
22
222
224
23
26
2
27
25
24
241
243
242
244

12
11
1
13

31
3
32

441
44
442
43
4
41
42
45

62
6
64
61
65
63

5
51

COMBINATION OF SPORTS GAME APPARATUS

BACKGROUND OF THE INVENTION

The present invention relates to a combination of sports game apparatus which can be rapidly arranged into a framework for a net assembly for badminton or tennis, a framework for a goal for soccer or hockey, or a framework for a back stop for basketball.

When to play a particular ball game, people shall have to go to a particular court, field or place where the requisite facilities are available. For example, when to play the game of basketball, people shall have to go to a basketball court, or a place where a back stop is available. Further, the residents of a building or buildings may play games in a nearby open field or yard. However, the residents of a building or buildings cannot play a variety of ball games in the surrounding field due to the limitation of limited open space and the lack of requisite facilities.

SUMMARY OF THE INVENTION

The present invention has been accomplished under the circumstances in view. It is one object of the present invention to provide a combination of sports game apparatus which can be rapidly arranged into a framework for a net assembly for badminton or tennis, a framework for a goal for soccer or hockey, or a framework for a back stop for basketball. It is another object of the present invention to provide a combination of sports game apparatus which can be conveniently set up into any of a variety of frameworks for different ball games without the use of a tool. It is still another object of the present invention to provide a combination of sports game apparatus which can be conveniently carried to any desired place and then set into any of a variety of frameworks for different ball games without the use of a tool. According to the present invention, the combination of sports game apparatus comprises a plurality of U-blocks, a plurality of triangle blocks, a plurality of elongated tubes, a plurality of L-bars, a plurality of angle connectors, and a plurality of coupling tubes. The elongated tubes can be connected in line, coupled to the L-bars or the triangle blocks by the coupling tubes. Two L-bars can be connected together at an angle by one angle connector. An U-block can be used to connect two triangle blocks together, or to secure one L-bar to the ground.

DETAILED DESCRIPTION OF THE PREFERRED EMBODIMENT

Figures 1A, 1B, 1C, 1D, 1E, 1F:
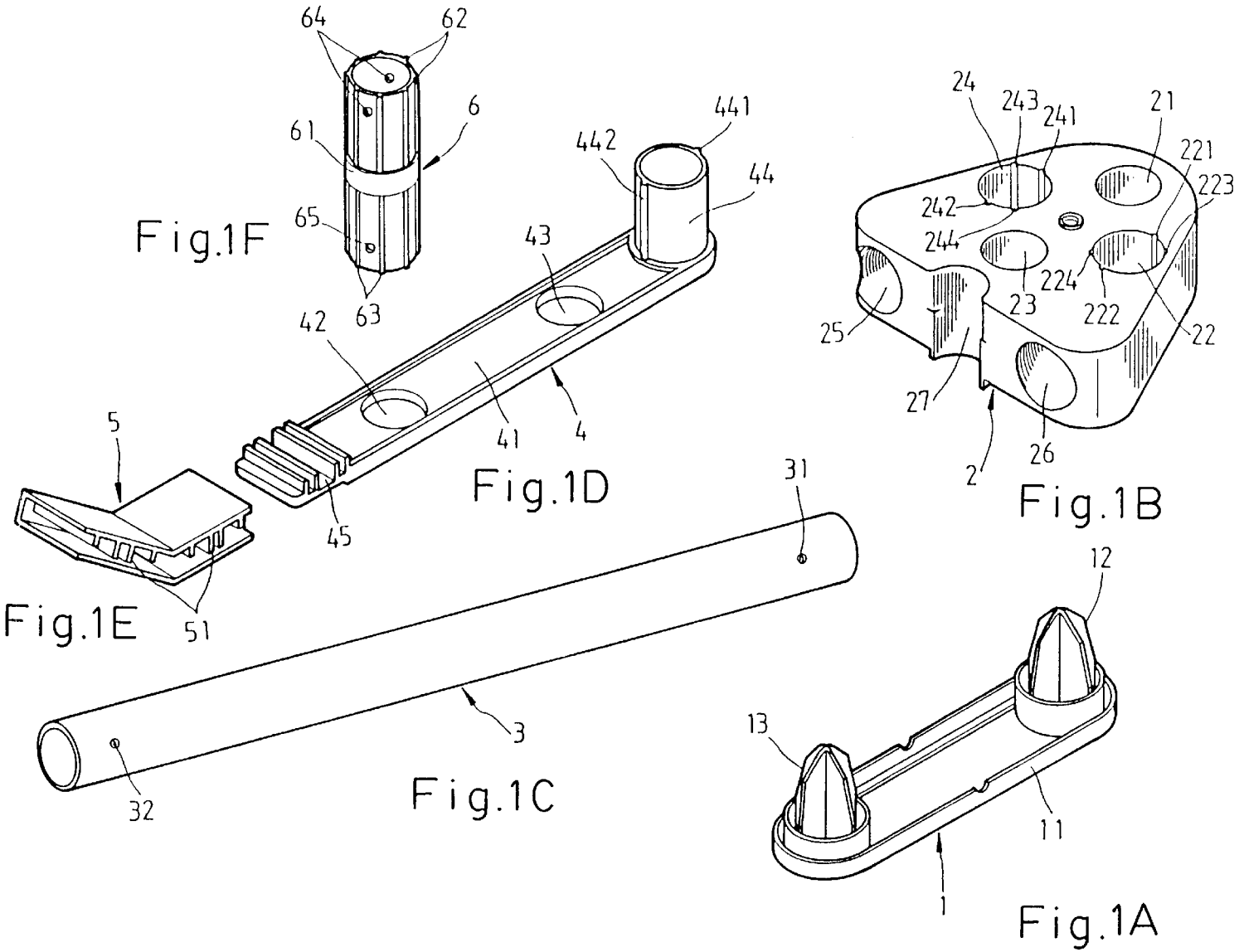
FIGS. 1A–1F show the six basic elements of the present invention.

Referring to FIGS. 1A–1F, a combination of sports game apparatus in accordance with the present invention is generally comprised of a plurality of U-blocks 1, a plurality of triangle blocks 2, a plurality of elongated tubes 3, a plurality of L-bars 4, a plurality of angle connectors 5, and a plurality of coupling tubes 6.

Each U-block 1 comprises an elongated block body 11 and two crossed plug members 12;13 perpendicularly raised from the elongated block body 11 and disposed in parallel. Each triangle block 2 comprises a first circular through hole 21, a second circular through hole 22, a third circular through hole 23 and a fourth circular through hole vertically disposed through its top and bottom sides at the vertices of a rhombus, two circular plug holes 25;26 horizontally and bilaterally disposed at one lateral side, and a semicircular vertical groove 27 disposed at one lateral side in the middle between the circular plug holes 25;26, wherein the first circular through hole 21 and the third circular through hole 23 as well as the second circular through hole 22 and the fourth circular through hole 24 are respectively arranged in a diagonal manner; the second circular through hole 22 has a first symmetrical pair of vertical grooves 221;222 and a second symmetrical pair of vertical grooves 223;224 longitudinally disposed at the periphery; the fourth circular through hole 24 has a first symmetrical pair of vertical grooves 241;242 and a second symmetrical pair of vertical grooves 243;244 longitudinally disposed at the periphery; the radial line between the first symmetrical pair of vertical grooves 221;222 of the second circular through hole 22 and the radial line between the first symmetrical pair of vertical grooves 241;242 of the fourth circular through hole 24 are disposed in parallel to the diagonal line between the first circular through hole 21 and the third circular through hole 23; the line which passes through the first symmetrical pair of vertical grooves 221;222 of the second circular through hole 22 and the line which passes through the first symmetrical pair of vertical grooves 241;242 of the fourth circular through hole 24 intersects each other; the diagonal line between the second circular through hole 22 and the fourth circular through hole 24 is disposed in parallel to the lateral side at which the circular plug holes 25;26 and semicircular vertical groove 27 are disposed. Each elongated tube 3 has an outer diameter fitting the diameter of the circular plug holes 25;26 of the triangle blocks 2, and two symmetrical pairs of radial pin holes 31;32 near its two opposite ends. Each L-bar 4 comprises an elongated, flat base 41, an upright stub tube 441 raised from one end of the flat base 41 and having two longitudinal ribs 441;442 raised from the periphery at two opposite side, a plurality of transverse teeth 45 disposed at an opposite end of the flat base 41, and two circular through holes 42;43 spaced between the upright stub tube 441 and the transverse teeth 45 and adapted for receiving the two crossed plug members 12;13 of the U-block 1. The upright stub tube 44 is adapted for coupling to the second circular through hole 22 or fourth circular through hole 24 of one triangle block 2. The line which passes the longitudinal ribs 441;442 is disposed in parallel to the longitudinal central axis of the flat base 41. When the upright stub tube 44 is plugged into the second circular through hole 22 or fourth circular through hole 24 of one triangle block 2, the longitudinal ribs 441;442 are forced into engagement with the first symmetrical pair of vertical grooves 221;222 (241;242) or second symmetrical pair of vertical grooves 223;224 (242;244) of the circular through hole 22 (24) of the corresponding triangle block 2. The inner diameter of the upright stub tube 44 of each L-bar 4 fits the outer diameter of each elongated tube 3 so that one elongated tube 3 can be plugged into the upright stub tube 44 of one L-bar 4. Each angle connector 5 is a hollow, about 150° angle plate of U-shaped cross section adapted for connecting two L-bars 4 together, having a plurality of transverse teeth 51 at an inner side for engagement with the transverse teeth 45 of one L-bar 4. Each coupling tube 6 comprises an annular flange 61 raised around the periphery in the middle, two sets of longitudinal ribs 62;63 respectively raised from the periphery and extended from the annular flange 61 to its two opposite ends, and two symmetrical pairs of radial pin holes 63;64 near its two opposite ends corresponding to the radial pin holes 31;32 of the elongated tubes 3. One elongated tube 3 can be connected to one L-bar 4 by one coupling tube 6 by: plugging one end of the coupling tube 6 into the upright stub tube 44 of the L-bar 4 and the other end thereof into one end of the elongated tube 3, permitting the respective one symmetrical pair of radial pin holes 64 or 65 of the coupling tube 6 to be connected to one symmetrical pair of radial pin holes 31 or 32 of the elongated tube 3 by a pin.

Figure 2:
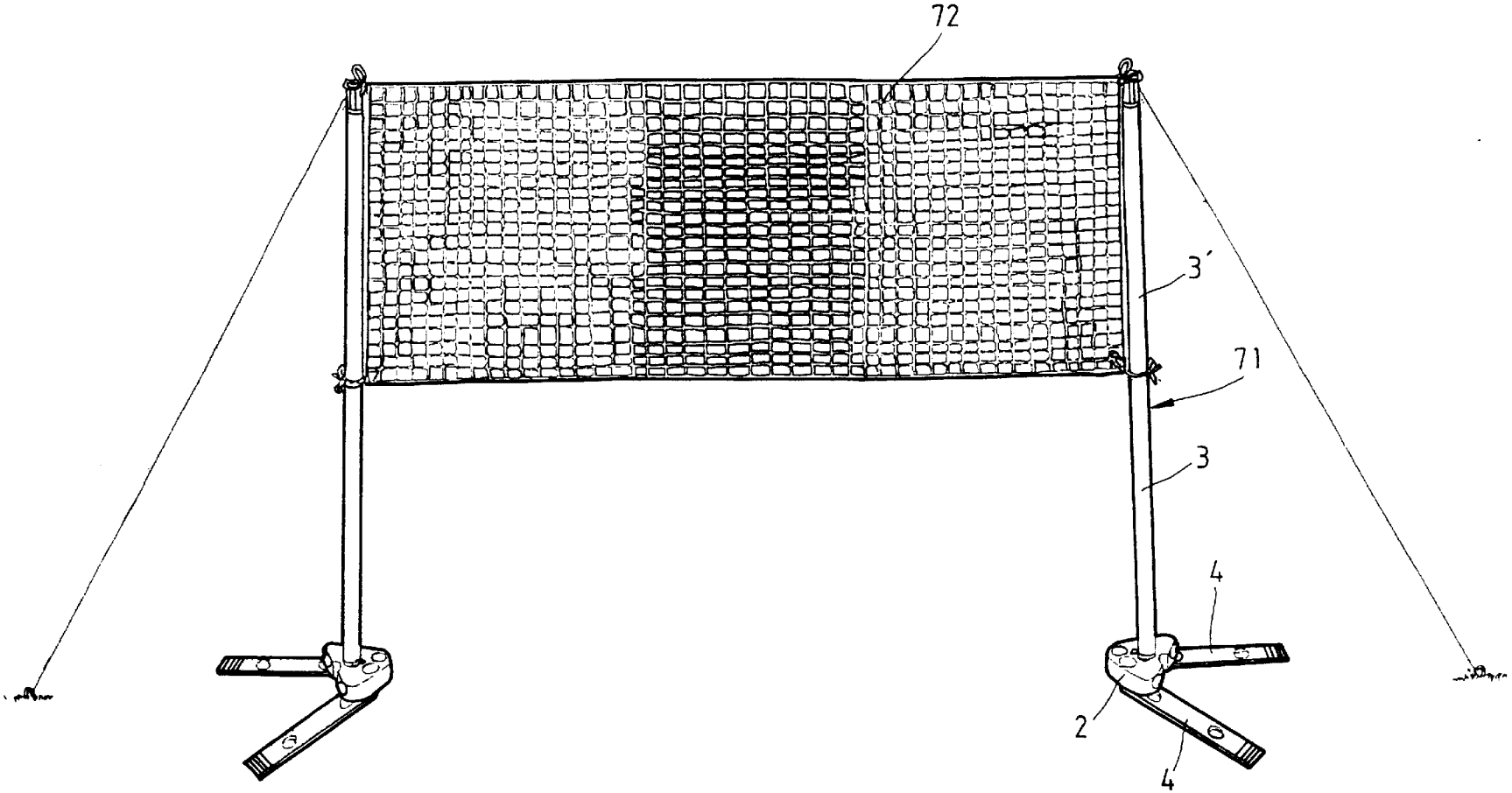
FIG. 2 is an elevational view of a net assembly for badminton constructed according to the present invention.
Figure 3:
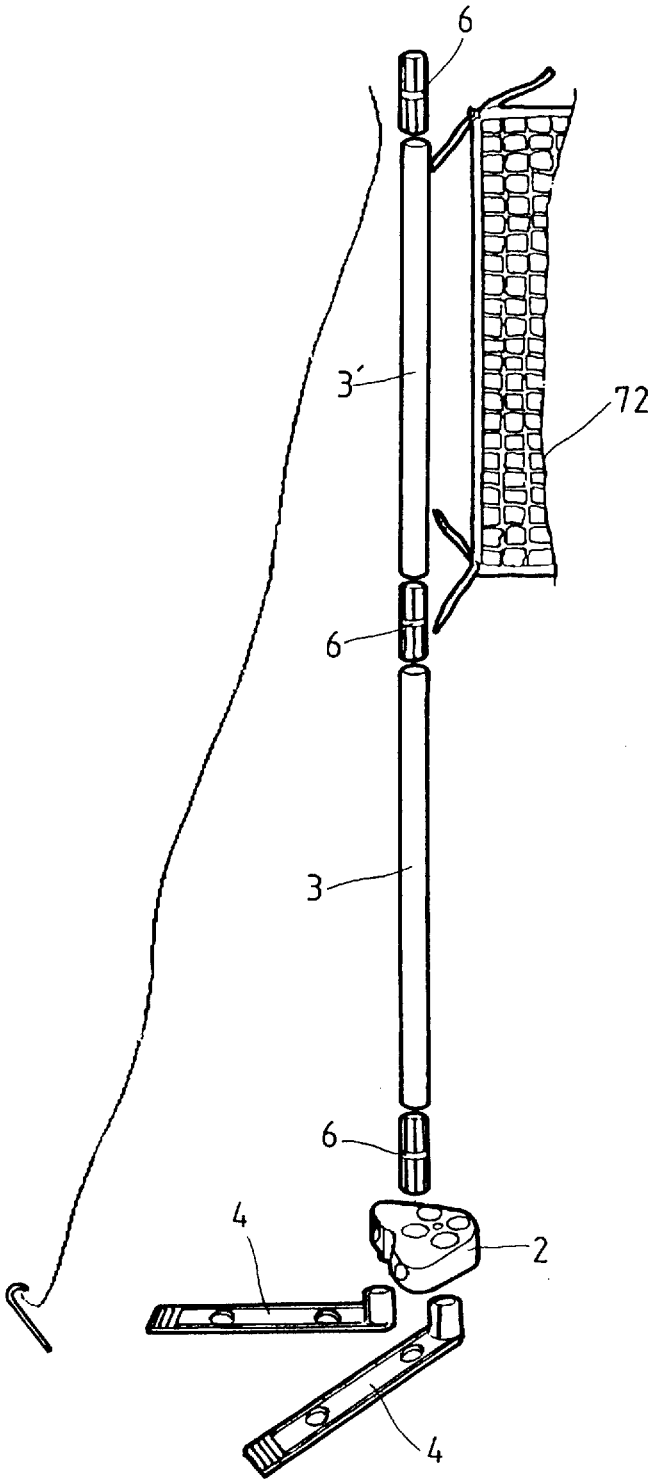
FIG. 3 is an exploded view of one stand of the net assembly shown in FIG. 2.

Referring to FIGS. 2 and 3, the present invention can be arranged into two stands 71 and set with a net 72 into a net assembly for badminton or tennis, in which each stand 71 is comprised of one triangle block 2, two L-bars 4 with the respective upright stub tubes 44 respectively fitted into the second and fourth circular through holes 22;24 of the triangle block 2 from the bottom side, one coupling tube 6, and two elongated tubes 3;3' longitudinally connected together by the coupling tube 6 and then fitted into the third circular through hole 23 of the triangle block 3. When the stands 71 are set up, the net 71 is hung up between the stands 71.

Figures 4, 4A:
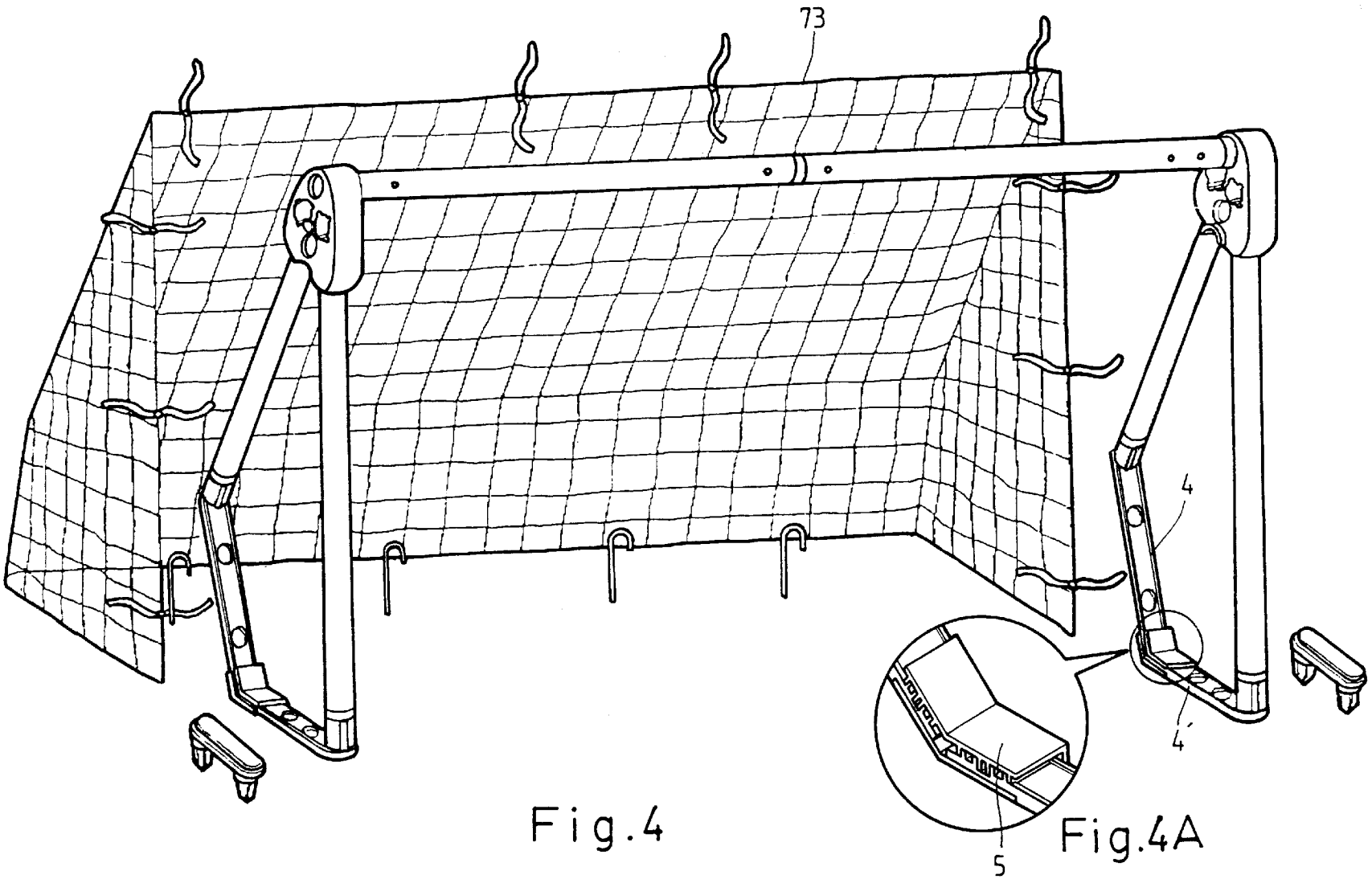
FIG. 4 is an elevational view of a goal constructed according to the present invention.
FIG. 4A is an enlarged view of a part of FIG. 4.
Figure 5:
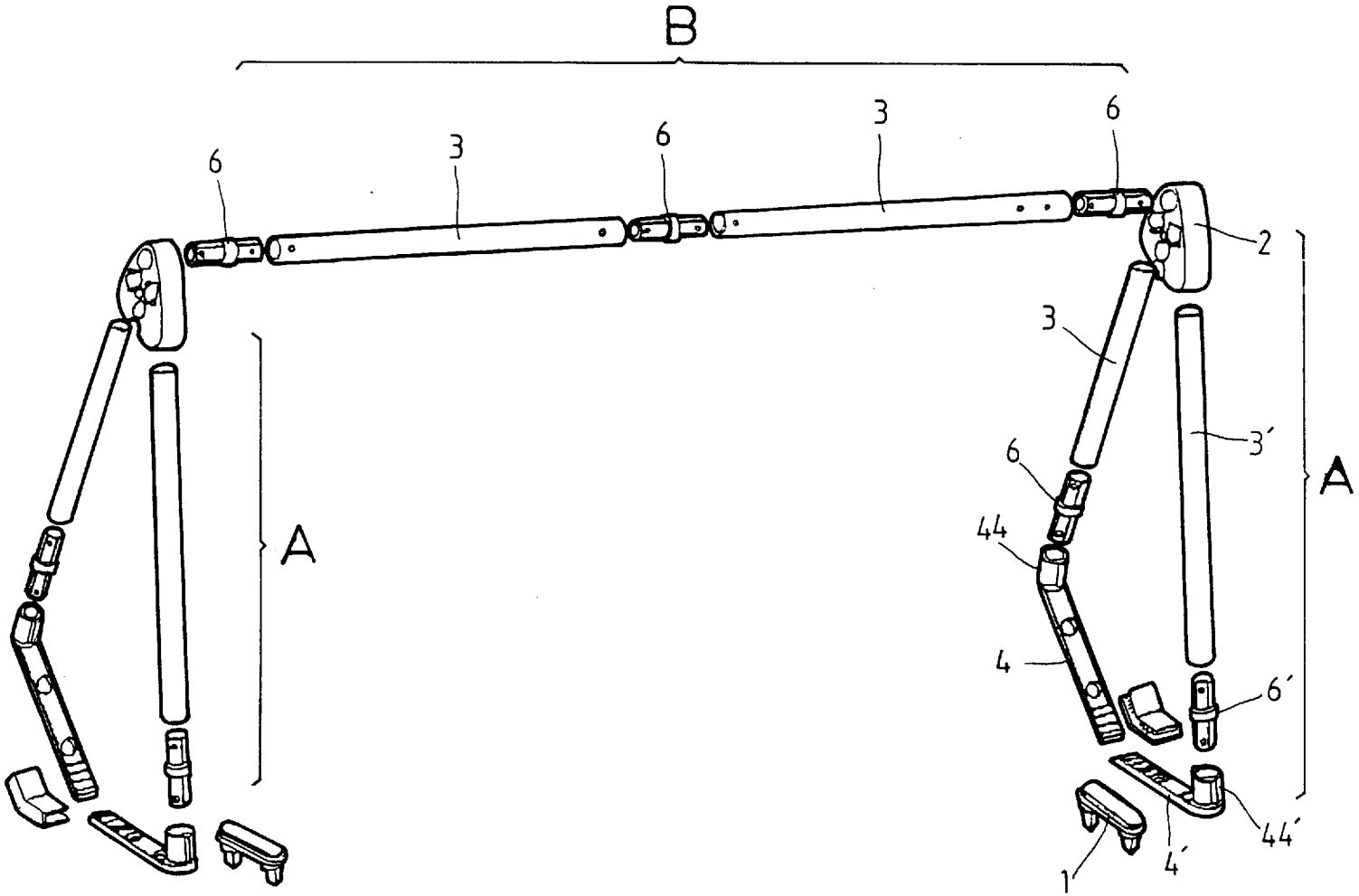
FIG. 5 is an exploded view of the framework of the goal shown in FIG. 4.

Referring to FIGS. 4 and 5, the present invention can be arranged into a framework and set with a net 73 into a goal for soccer or hockey, in which the framework is comprised of two stands A and a crossbar B connected between the stands A; each stand A is comprised of two L-bars 4 connected together by one angle connector 5, a triangle block 2, two elongated tubes 3;3' respectively fitted into the circular plug holes 25;26 of the triangle block 2 (see also FIG. 1), two coupling tubes 6;6' respectively connected between the elongated tubes 3;3' and the upright stub tubes 44 of the L-bars 4, and one U-block 1 fastened to one L-bar 4 to secure it to the ground by plugging the crossed plug members 12;13 of the U-block 1 through the circular through holes 42;43 of the L-bar 4 into the ground; the crossbar B is comprised of two elongated tubes 3 and three coupling tubes 6 alternatively connected in series between the triangle blocks 2 of the stands A.

Figure 6:
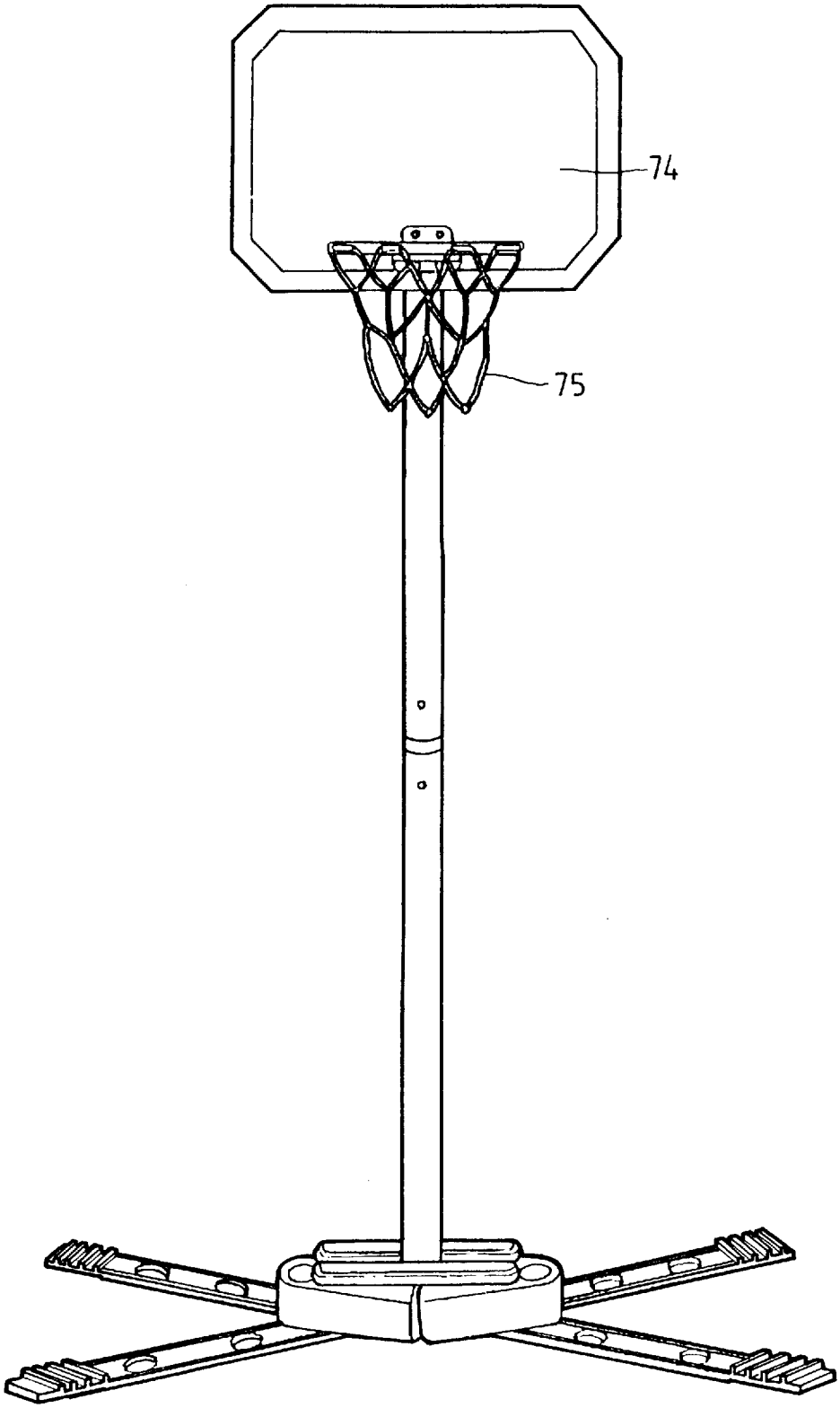
FIG. 6 shows a back stop for basketball constructed according to the present invention.
Figure 7:
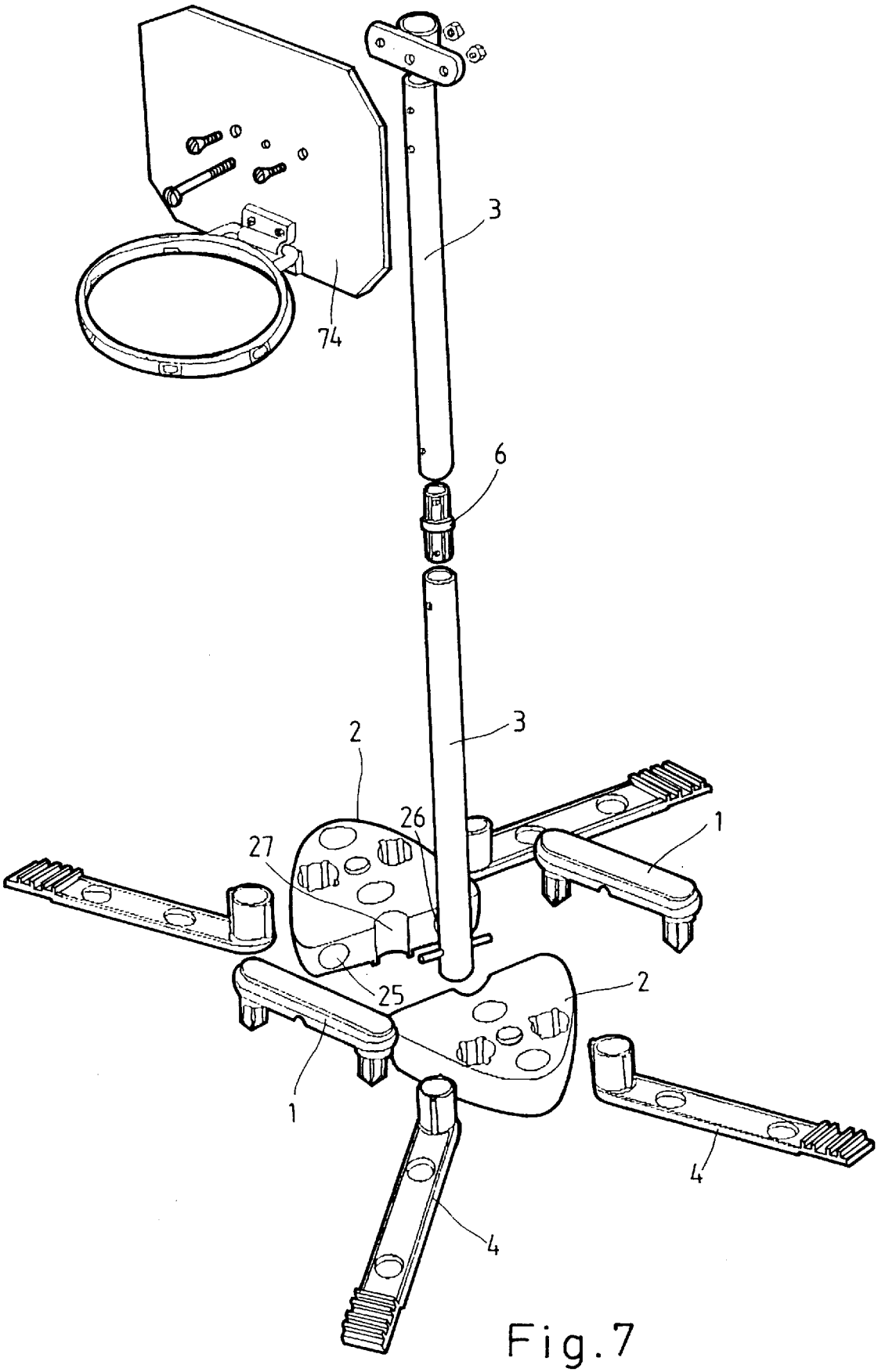
FIG. 7 is an exploded view of FIG. 6 (the net excluded).

Referring to FIGS. 6 and 7, the present invention can be arranged into a stand and set with a backboard 74 and a net 75 into a back stop for basketball, in which the stand is comprised of two triangle blocks 2 which are abutted against each other with the respective circular plug holes 25;26 respectively aligned, one coupling tube 6, two elongated tubes 3 longitudinally connected together by the coupling tube 6 and then plugged into the semicircular vertical grooves 27 of the abutted triangle blocks 2, four L-bars 4 respectively fastened to the triangle blocks 2 by plugging the respective upright stub tubes 44 of the L-bars 4 into the second and fourth circular through holes 22;24 of the triangle blocks 2 from the bottom side, and two U-blocks 1 connected between the abutted triangle blocks 2 to secure the triangle blocks 2 and the L-bars 4 together by plugging the crossed plug members 12;13 of the U-blocks 1 into the upright stub tubes 44 of the L-bars 4 from the top side.

It is to be understood that the drawings are designed for purposes of illustration only, and are not intended as a definition of the limits and scope of the invention disclosed.

What the invention claimed is:

1. A combination of sports game apparatus adapted to be alternatively arranged into a framework for a net assembly for badminton or tennis, a framework for a goal for soccer or hockey, or a framework for a back stop for basketball, comprised of a plurality of U-blocks, a plurality of triangle blocks, a plurality of elongated tubes, a plurality of L-bars, a plurality of angle connectors, and a plurality of coupling tubes, wherein:

each of said U-blocks comprises an elongated block body and two crossed plug members perpendicularly raised from said elongated block body and disposed in parallel;

each of said triangle blocks comprises a first circular through hole, a second circular through hole, a third circular through hole and a fourth circular through hole vertically disposed through top and bottom sides thereof, two circular plug holes horizontally and bilaterally disposed at one lateral side thereof, and a semicircular vertical groove disposed between said circular plug holes, said first circular through hole and said third circular through hole as well as said second circular through hole and said fourth circular through hole being respectively arranged in a diagonal manner, said second circular through hole having a first symmetrical pair of vertical grooves and a second symmetrical pair of vertical grooves longitudinally disposed at the periphery, said fourth circular through hole having a first symmetrical pair of vertical grooves and a second symmetrical pair of vertical grooves longitudinally disposed at the periphery, the radial line between the first symmetrical pair of vertical grooves of said second circular through hole and the radial line between the first symmetrical pair of vertical grooves of said fourth circular through hole being disposed in parallel to the diagonal line between said first circular through hole and said third circular through hole, the line which passes through the first symmetrical pair of vertical grooves of said second circular through hole and the line which passes through the first symmetrical pair of vertical grooves of said fourth circular through hole intersecting each other, the diagonal line between said second circular through hole and said fourth circular through hole being disposed in parallel to the lateral side at which said circular plug holes and semicircular vertical groove are disposed;

each of said elongated tubes has an outer diameter fitting the diameter of the circular plug holes of said triangle blocks, and two symmetrical pairs of radial pin holes near two opposite ends thereof;

each of said L-bars comprises an elongated, flat base, an upright stub tube raised from one end of said flat base and having two longitudinal ribs raised from the periphery at two opposite side, a plurality of transverse teeth disposed at an opposite end of said flat base, and two circular through holes spaced between said upright stub tube and said transverse teeth and adapted for receiving the two crossed plug members of one of said U-blocks, said upright stub tube being adapted for coupling to the second circular through hole or fourth circular through hole of one of said triangle blocks, the line which passes the longitudinal ribs of said upright stub tube being disposed in parallel to the longitudinal central axis of said flat base, the longitudinal ribs of said upright stub tube being adapted for engaging the first symmetrical pair of vertical grooves or second symmetrical pair of vertical grooves of the second circular through hole or fourth circular through hole of one of said triangle blocks, the inner diameter of the upright stub tube of each of said L-bars fitting the outer diameter of each of said elongated tubes so that one elongated tube can be plugged into the upright stub tube of one L-bar;

each of said angle connectors is a hollow, about 150° angle plate of U-shaped cross section adapted for connecting two L-bars together, having a plurality of transverse teeth at an inner side for engagement with the transverse teeth of one of said L-bars;

each of said coupling tubes comprises an annular flange raised around the periphery and equally spaced from two opposite ends thereof, two sets of longitudinal ribs respectively raised from the periphery and extended from the annular flange to its two opposite ends, and two symmetrical pairs of radial pin holes near its two opposite ends corresponding to the radial pin holes of said elongated tubes.

* * * * *